US012228350B2

(12) United States Patent
Onaka et al.

(10) Patent No.: US 12,228,350 B2
(45) Date of Patent: Feb. 18, 2025

(54) HEAT EXCHANGER AND REFRIGERATION CYCLE APPARATUS

(71) Applicant: Mitsubishi Electric Corporation, Tokyo (JP)

(72) Inventors: Yoji Onaka, Tokyo (JP); Takashi Matsumoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/766,735

(22) PCT Filed: Nov. 11, 2019

(86) PCT No.: PCT/JP2019/044086
§ 371 (c)(1),
(2) Date: Apr. 6, 2022

(87) PCT Pub. No.: WO2021/095087
PCT Pub. Date: May 20, 2021

(65) Prior Publication Data
US 2024/0085122 A1 Mar. 14, 2024

(51) Int. Cl.
*F28F 17/00* (2006.01)
*F28D 21/00* (2006.01)
*F28F 1/12* (2006.01)

(52) U.S. Cl.
CPC ..... *F28F 1/128* (2013.01); *F28D 21/00* (2013.01); *F28F 17/005* (2013.01); *F28D 2021/0068* (2013.01)

(58) Field of Classification Search
CPC ..... F28F 1/128; F28F 21/00; F28F 17/005; F28F 2021/0068
See application file for complete search history.

(56) References Cited

U.S. PATENT DOCUMENTS

2007/0084589 A1 4/2007 Nishino et al.
2017/0082381 A1 3/2017 Sugimura et al.
2020/0103418 A1 4/2020 Matsumoto et al.

FOREIGN PATENT DOCUMENTS

EP 3015808 A1 5/2016
EP 3173725 A1 5/2017
(Continued)

OTHER PUBLICATIONS

International Search Report and Written Opinion mailed on Dec. 10, 2019, received for PCT Application PCT/JP2019/044086, Filed on Nov. 11, 2019, 10 pages including English Translation.
(Continued)

*Primary Examiner* — Devon Russell
(74) *Attorney, Agent, or Firm* — XSENSUS LLP

(57) ABSTRACT

A heat exchanger includes: flat heat exchange tubes each having an elongated cross section and planar outer surfaces that face each other, and each including a fluid flow passage; and corrugated fins each formed in the shape of waves and provided between associated adjacent ones of the heat exchange tubes. The corrugated fins each having ridge portions that correspond to ridges of the waves and that are joined to the associated heat exchange tubes, the corrugated fin having fins that are located between the ridge portions and are arranged in a height direction. The fins include drain slits each of which allows drainage of water on an associated one of the fins, and end portions of the drain slits of adjacent ones of the fins in a horizontal direction are located at different positions in the drain slits, the adjacent fins being adjacent to each other in the height direction.

11 Claims, 9 Drawing Sheets

(56) References Cited

FOREIGN PATENT DOCUMENTS

| | | | | | |
|---|---|---|---|---|---|
| JP | 59-94270 | U | | 6/1984 | |
| JP | 2007113802 | A | * | 5/2007 | ..... F28D 1/05391 |
| JP | 2015-183908 | A | | 10/2015 | |
| WO | WO-2014207785 | A1 | * | 12/2014 | ..... F28F 1/126 |
| WO | WO-2016013100 | A1 | * | 1/2016 | ..... F25B 39/02 |
| WO | WO-2017154175 | A1 | * | 9/2017 | ..... F25B 39/02 |
| WO | 2018154806 | A1 | | 8/2018 | |

OTHER PUBLICATIONS

Extended European Search Report issued Oct. 10, 2022 in corresponding European Patent Application No. 19952231.9, 6 pages.
Office Action issued on Jun. 15, 2024, in corresponding Chinese patent Application No. 201980102001.8, 13 pages.
Office Action dated Aug. 17, 2024 issued in corresponding CN patent application No. 201980102001.8.

* cited by examiner

HEAT EXCHANGER AND REFRIGERATION CYCLE APPARATUS

CROSS-REFERENCE TO RELATED APPLICATION

The present application is based on PCT filing PCT/JP2019/044086, filed Nov. 11, 2019, the entire contents of which are incorporated herein by reference.

TECHNICAL FIELD

The present disclosure relates to a heat exchanger and a refrigeration cycle apparatus. In particular, it relates to a heat exchanger including a combination of corrugated fins and flat heat exchange tubes and an air-conditioning apparatus including the heat exchanger.

Background Art

For example, a corrugated finned tube heat exchanger has been widely used in which corrugated fins are each provided between associated ones of planar portions of a plurality of flat heat exchange tubes connected between a pair of headers through which refrigerant passes. Air passes as an air stream through between the flat heat exchange tubes between which an associated corrugated fin is provided. In such a heat exchanger, a surface temperature of the corrugated fin and/or the flat heat exchange tubes may fall below freezing. When the surface temperature falls, the moisture in air close to the surface is precipitated as water, and furthermore, the temperature falls below freezing, the water freezes. In view of this, in some heat exchangers, in order to drain such water, slits are provided as spaces in fins, and water deposited on a surface, that is, water as which moisture is precipitated on the surface, is let out through the slits (see, for example, Patent Literature 1).

CITATION LIST

Patent Literature

Patent literature 1: Japanese Unexamined Patent Application Publication No. 2015-183908

SUMMARY OF INVENTION

Technical Problem

An existing heat exchanger has a structure that lets out water deposited on a surface of a corrugated fin as described above. If the water remains on the corrugated fin, however, it is hard to let out the remaining water. For example, the remaining water freezes, and obstructs air that passes through the heat exchanger, thereby deteriorating the heat exchange performance of the corrugated fin.

The present disclosure is applied to solve the above problem, and relates to a heat exchanger and a refrigeration cycle apparatus that are capable of improving the drainage performance of a corrugated fin.

Solution to Problem

A heat exchanger according to an embodiment of the present disclosure includes: a plurality of flat heat exchange tubes each having an elongated cross section and planar outer surfaces that face each other, the flat heat exchange tubes each including a fluid flow passage therein; and a plurality of corrugated fins each formed in the shape of waves and provided between associated adjacent ones of the flat heat exchange tubes, each of the corrugated fins having ridge portions that correspond to ridges of the waves and that are joined to the associated flat heat exchange tubes, the corrugated fin having portions that are located between the ridge portions and formed as fins that are arranged in a height direction. The fins include respective drain slits each of which allows water on an associated one of the fins to be drained therethrough, and end portions of the drain slits of adjacent ones of the fins in a horizontal direction are located at different positions in the drain slits, the adjacent fins being adjacent to each other in the height direction.

A refrigeration cycle apparatus according to another embodiment of the present disclosure includes the heat exchanger described above.

Advantageous Effects of Invention

The heat exchanger according to the embodiment of the present disclosure includes the corrugated fin in which end portions of the drain slits of adjacent ones of the fins in a horizontal direction are located at different positions in the drain slits in the height direction. Thus, water from the upper one of the adjacent fins can be drained after being made to join water on the lower one of the adjacent fins. Therefore, it is possible to reduce remaining water on the fins, thus prevent freezing, etc., and further improve the heat exchange performance of the corrugated fin.

DESCRIPTION OF EMBODIMENTS

A heat exchanger and an air-conditioning apparatus according to embodiments will be described below with reference to the accompanying drawings, etc. In each of figures to be referred to below, components that are the same as or equivalent to those in a previous figure or previous figures are denoted by the same reference signs, and the same is true of the entire text of the present specification. Configurations of components described in the entire text of the specification are merely examples, and the descriptions of the configurations are not limiting. In particular, in the case where components are combined, it is not limited to the case where components according to the same embodiment are combined. A component in an embodiment can be applied to another embodiment. The "upper side" and "lower side" in the following description correspond to the upper side and lower side of each of the figures, respectively. In addition, in order that the embodiments be easily understood, terms related to directions (such as "right", "left", front", and "rear") are used as appropriate. However, these terms are used only for explanation, that is, they do not limit the contents of the embodiments. Furthermore, with respect to temperature and humidity, whether each of values is higher or lower is relatively determined based on the state, operation, etc., of an apparatus, etc., not based on the relationship between the value and an absolute value. In the figures, the relationships in size between components as illustrated in the figures may be different from that between those of actual components.

Embodiment 1

Figure 1:
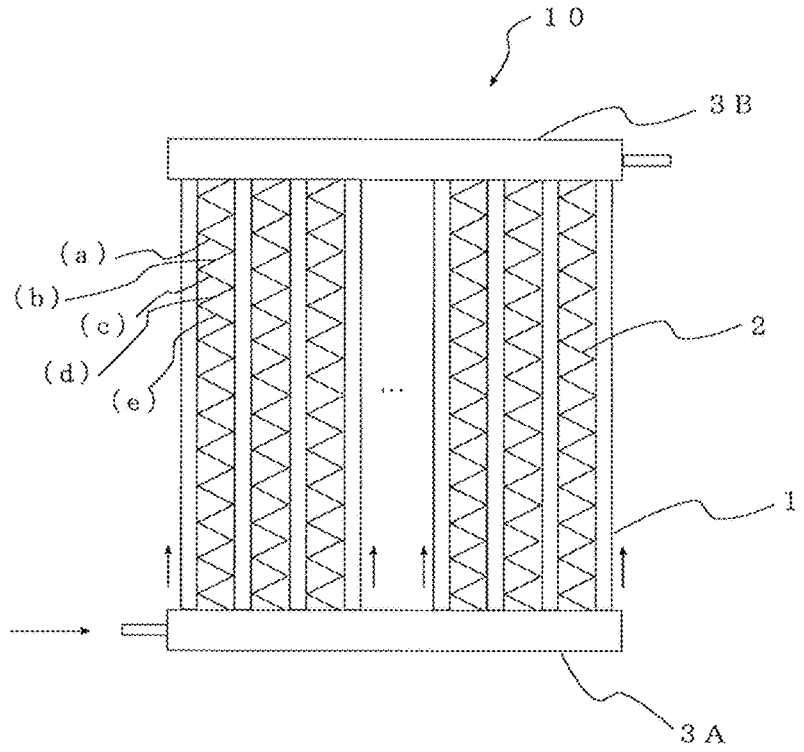
FIG. 1 is an explanatory view for a configuration of a heat exchanger according to Embodiment 1.

FIG. 1 is an explanatory view for a configuration of a heat exchanger according to Embodiment 1. As illustrated in FIG. 1, a heat exchanger 10 according to Embodiment 1 is a corrugated finned tube heat exchanger provided with tubes that are arranged in parallel. To be more specific, the heat exchanger 10 includes a plurality of flat heat exchange tubes 1, a plurality of corrugated fins 2, and a pair of headers 3 (header 3A and header 3B). In the following description, the up-down direction in FIG. 1 is referred to as a height direction; the lateral direction in FIG. 1 is referred to as a horizontal direction; and the front-back direction in FIG. 1 is referred to as a depth direction.

The headers 3 are tubes that are connected to other devices included in a refrigeration cycle apparatus by pipes, that allow inflow and outflow of refrigerant that is fluid serving as a heat exchange medium, and that cause the refrigerant to branch off or join each other. The plurality of flat heat exchange tubes 1 are arranged in parallel between the headers 3 in such a manner as to extend in a direction perpendicular to the headers 3. As illustrated in FIG. 1, in the heat exchanger 10 in Embodiment 1, the headers 3, that is, the two headers 3A and 3B, are provided on a lower side and an upper side, respectively, in the height direction. The header 3A, which allows liquid refrigerant to pass therethrough, is located on the lower side, and the header 3B, which allows gas refrigerant to pass therethrough, is located on the upper side.

Each of the flat heat exchange tubes 1 is a heat exchange tube that has an elongated cross section, has planar outer surfaces extending in a depth direction, which is the flow direction of air, on a longitudinal side of an elongated shape, and has curved outer surfaces on a width direction orthogonal to the longitudinal direction. The flat heat exchange tube 1 is a porous flat heat exchange tube having a plurality of holes that serve as flow passages for refrigerant. In Embodiment 1, the holes in the flat heat exchange tube 1 are refrigerant flow passages that extend between the headers 3 to face in the height direction. The flat heat exchange tubes 1 are arranged at regular intervals in the horizontal direction such that the outer surfaces of the flat heat exchange tubes 1 in the longitudinal direction thereof face each other. When the heat exchanger in Embodiment 1 is manufactured, the flat heat exchange tubes 1 are inserted into insertion holes (not illustrated) in the headers 3, and are brazed and joined thereto. As brazing material for the brazing, for example, a brazing material including aluminum is used.

When the heat exchanger 10 is used as a condenser, high-temperature and high-pressure refrigerant flows through the refrigerant flow passages in the flat heat exchange tube 1. When the heat exchanger 10 is used as an evaporator, low-temperature and low-pressure refrigerant flows through the refrigerant flow passages in the flat heat exchange tube 1. The refrigerant flows from an external device (not illustrated) into one of the headers 3 through a pipe (not illustrated) for use in supplying the refrigerant to the heat exchanger 10. The refrigerant that has flowed into the above one of the headers 3 is split into refrigerant streams, and the refrigerant streams flow through respective flat heat exchange tubes 1. In the flat heat exchange tubes 1, heat exchange is performed between the refrigerant that passes through the tubes and outside air that is the atmosphere that is present outside the tubes. At that time, the refrigerant transfers heat into the atmosphere or receives heat from the atmosphere while passing through the flat heat exchange tubes 1. When the temperature of the refrigerant is higher than that of the outside air, the refrigerant transfers heat from itself into the outside air. When the temperature of the refrigerant is lower than that of the outside air, the refrigerant receives heat from the atmosphere. The refrigerant that has passes through the flat heat exchange tubes 1 and exchanged the heat flows into the other header 3 and joins refrigerant in the other header 3. Then, the refrigerant flows through a pipe (not illustrated) connected to the other header 3 and returns to the external device (not illustrated).

Between a space between any adjacent two of flat surfaces of the flat heat exchange tubes 1, an associated one of the corrugated fins 2 is provided. The corrugated fin 2 is provided to increase a heat transfer area between the refrigerant and the outside air. The corrugated fin 2 is formed by performing corrugating processing on a plate material such that the plate material is bent and corrugated in the shape of an accordion by wining in which mountain fold and valley fold are repeated. It should be noted that bent portions of the corrugated plate material are ridge portions. In Embodiment 1, the ridge portions of the corrugated fin 2 are arranged in the height direction.

Figure 2:
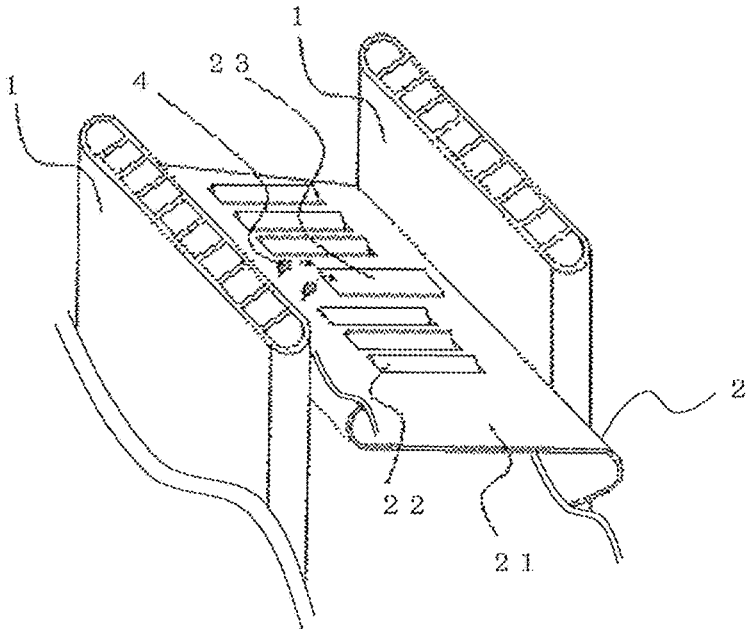
FIG. 2 is an explanatory view for a corrugated fin according to Embodiment 1.

FIG. 2 is an explanatory view for the corrugated fin according to Embodiment 1. In the corrugated fin 2, except for one end portion projecting toward the upstream side from the space between any adjacent two of the flat heat exchange tubes 1 in the flow direction, the ridge portions of the corrugated fin 2 are in surface contact with the flat surfaces of the flat heat exchange tubes 1, and are brazed and joined to the flat surfaces with brazing material. The plate material for the corrugated fin 2 may be, for example, an aluminum alloy. The surface of the plate material is clad with a brazing material layer. As a base of this brazing material layer, a brazing material containing aluminum-silicon based aluminum is used. It should be noted that the thickness of the plate material is approximately 50 to 200 μm.

Portions of the corrugated fin that are located at mountainsides between the ridge portions of the corrugated fin 2 are fins 21. Each of the fins 21 includes louvers 22 and a drain slit 23. In the fin 21, the louvers 22 are arranged in the depth direction that is the flow direction of air at the fin 21. Thus, the louvers 22 are arranged along the air stream. The louvers 22 include slits that allow air to pass therethrough and plate portions that guides the air passing through the slits. The drain slit 23 is provided at a position corresponding to a central portion of the associated flat heat exchange tube 1 in the depth direction in the fin 21. The drain slit 23 extends to have a rectangular shape in the horizontal direction. It should be noted that in the drain slits 23 of adjacent ones of the fins 21 in the heat exchanger 10 in Embodiment 1 in the height direction, center positions of the drain slits 23 in the horizontal direction are offset from each other, and the positions of end portions of the drain slits 23 in the horizontal direction are also offset from each other, as described below. The corrugated fins 2 will be described in more details later.

Figure 3:
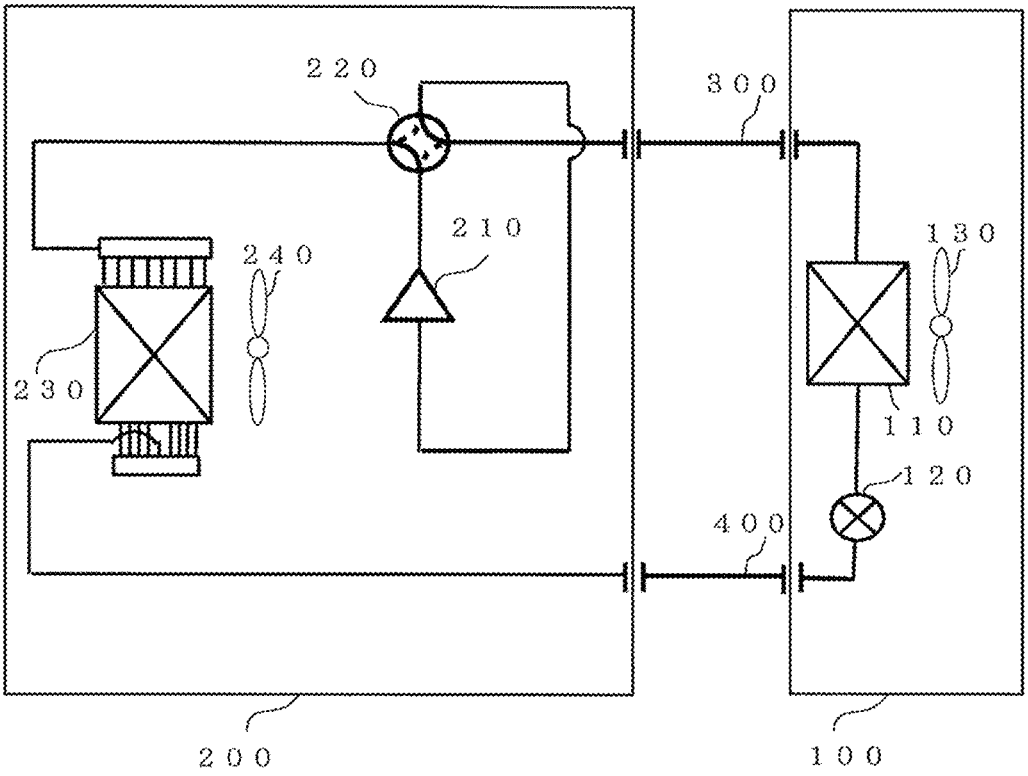
FIG. 3 illustrates a configuration of an air-conditioning apparatus according to Embodiment 1.

FIG. 3 illustrates a configuration of an air-conditioning apparatus according to Embodiment 1. Regarding Embodiment 1, as an example of the refrigeration cycle apparatus, the air-conditioning apparatus will be described. In the air-conditioning apparatus as illustrated in FIG. 3, the heat exchanger 10 is used as an outdoor heat exchanger 230. However, use of the heat exchanger 10 is not limited to such a use. The heat exchanger 10 may be used as an indoor heat exchanger 110, or heat exchangers 10 may be used as both the outdoor heat exchanger 230 and the indoor heat exchanger 110.

As illustrated in FIG. 3, in the air-conditioning apparatus, an outdoor unit 200 and an indoor unit 100 are connected by a gas refrigerant pipe 300 and a liquid refrigerant pipe 400, whereby a refrigerant circuit is provided. The outdoor unit 200 includes a compressor 210, a four-way valve 220, an outdoor heat exchanger 230, and an outdoor fan 240. In the air-conditioning apparatus according to Embodiment 1, one outdoor unit 200 and one indoor unit 100 are connected by the pipes.

The compressor 210 compresses sucked refrigerant and discharges the compressed refrigerant. Although it is not particularly limited, it is possible to change the capacity of the compressor 210 by arbitrarily changing the operation frequency thereof using, for example, an inverter circuit. The four-way valve 220 is, for example, a valve that switches the flow direction of refrigerant between the flow direction of the refrigerant for a cooling operation and that for a heating operation.

The outdoor heat exchanger 230 causes heat exchange to be performed between the refrigerant and the outdoor air. For example, in the heating operation, the outdoor heat exchanger 230 operates as an evaporator and causes the refrigerant to evaporate and gasify; and in the cooling operation, the outdoor heat exchanger 230 operates as a condenser and causes the refrigerant to condense and liquefy. The outdoor fan 240 sends outdoor air into the outdoor heat exchanger 230 and promotes the heat exchange at the outdoor heat exchanger 230.

The indoor heat exchanger 110 causes heat exchange to be performed between the refrigerant and, for example, indoor air to be conditioned. In the heating operation, the indoor heat exchanger 110 operates as a condenser and causes the refrigerant to condense and liquefy; and in the cooling operation, the indoor heat exchanger 110 operates as an evaporator and causes the refrigerant to evaporate and gasify.

The indoor unit 100 includes the indoor heat exchanger 110, an expansion valve 120, and an indoor fan 130. The expansion valve 120, such as a throttle device, decompresses the refrigerant to expand the refrigerant. For example, when the expansion valve 120 is an electronic expansion valve or a similar valve, the expansion valve 120 adjusts the opening degree in response to an instruction given from a controller (not illustrated) or a similar device. The indoor heat exchanger 110 causes heat exchange to be performed between the refrigerant and air in an indoor space that is air-conditioned space. For example, in the heating operation, the indoor heat exchanger 110 operates as a condenser and causes the refrigerant to condense and liquefy; and in the cooling operation, the indoor heat exchanger operates as an evaporator and causes the refrigerant to evaporate and gasify. The indoor fan 130 sends indoor air into the indoor heat exchanger 110 in order that the indoor air that has passed through the indoor heat exchanger 110 be supplied into the indoor space.

Next, the operation of each of components in the air-conditioning apparatus will be described based on the flow of the refrigerant. First of all, it will be described how each component in the refrigerant circuit operates in the heating operation, based on the flow of the refrigerant. High-temperature and high-pressure gas refrigerant compressed and discharged by the compressor 210 passes through the four-way valve 220 and flows into the indoor heat exchanger 110. While passing through the indoor heat exchanger 110, gas refrigerant exchanges heat with, for example, air in an air-conditioned space to condense and liquefied. Then, the refrigerant passes through the expansion valve 120. When passing through the expansion valve 120, the refrigerant is decompressed to change into two-phase gas-liquid refrigerant. The two-phase gas-liquid refrigerant passes through the outdoor heat exchanger 230. In the outdoor heat exchanger 230, the refrigerant exchanges heat with outdoor air sent from the outdoor fan 240 to evaporate and gasify. Then, the refrigerant passes through the four-way valve 220 and is re-sucked into the compressor 210. In the above manner, the refrigerant in the air-conditioning apparatus circulates, and air conditioning related to heating is performed.

Next, the cooling operation will be described. High-temperature and high-pressure gas refrigerant compressed and discharged by the compressor 210 passes through the four-way valve 220 and flows into the outdoor heat exchanger 230. Then, the refrigerant passes through the outdoor heat exchanger 230, exchanges heat with the outdoor air supplied by the outdoor fan 240, and thus condenses to change into liquid refrigerant. The liquid refrigerant passes through the expansion valve 120. While passing through the expansion valve 120, the refrigerant is decompressed to change into two-phase gas-liquid refrigerant. The two-phase gas-liquid refrigerant passes through the indoor heat exchanger 110. In the indoor heat exchanger 110, for example, the refrigerant exchanges heat with air in the air-conditioned space, and thus evaporates to change into gas refrigerant. The gas refrigerant passes through the four-way valve 220 and is re-sucked into the compressor 210. In the above manner, the refrigerant in the air-conditioning apparatus circulates, and air conditioning related to heating is performed.

As described above, when the heat exchanger 10 operates as the evaporator, the temperatures of the surfaces of the flat heat exchange tubes 1 and the corrugated fins 2 are lower than that of air that passes through the heat exchanger 10. Therefore, with moisture in the air, condensation occurs on the surfaces of the flat heat exchange tubes 1 and the corrugated fins 2, and condensed water 4 is deposited.

In each of the corrugated fins 2, condensed water 4 that condenses on the surface of a fin 21 flows into the drain slit 23 of the fin 21 and falls down toward a lower fin 21. At that time, in a region where the amount of the condensed water 4 is large, the condensed water 4 easily flows on the surface of the fin 21 and easily falls down through the drain slit 23. On the other hand, in a region where the amount of the condensed water 4 is small, the condensed water 4 tends to be retained and remain on the surface of the fin 21, and does not easily flow.

Figure 4:
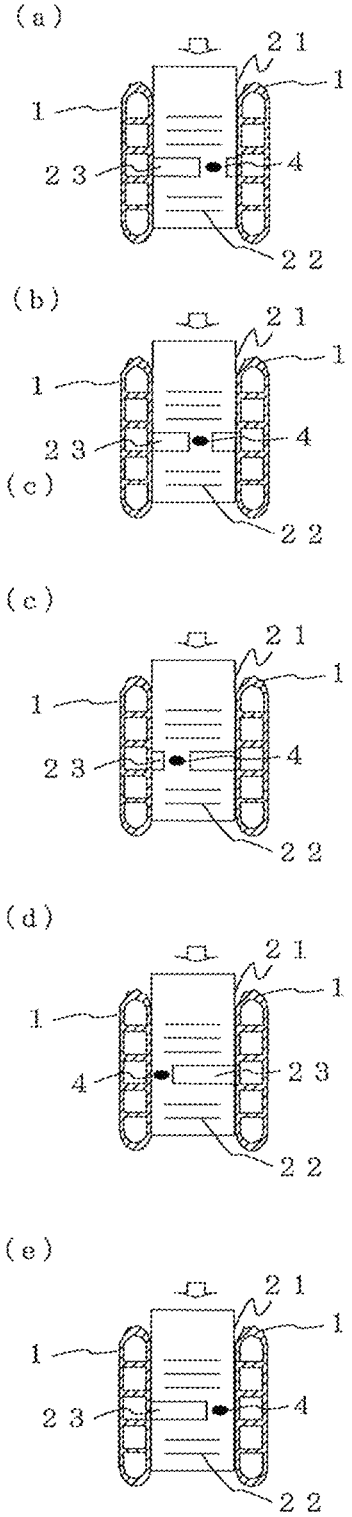
FIG. 4 is an explanatory view for a positional relationship between drain slits in fins of the corrugated fin according to Embodiment 1.

FIG. 4 is an explanatory view for a positional relationship between the drain slits in fins in the corrugated fin according to Embodiment 1. FIGS. 4, (a), to 4, (e), schematically illustrate the fins 21 at positions (a) to (e) in FIG. 1, respectively.

As described above, in the heat exchanger 10 according to Embodiment 1, the drain slit 23 in one of fins 21 that are adjacent to each other in the height direction is located such that the position of the above drain slit 23 in the horizontal direction is displaced from that of the drain slit 23 in the other fin 21 in the horizontal direction. Although it is not particularly limited, in the heat exchanger 10 in Embodiment 1, it is assumed that drain slits 23 whose central positions are the same as each other are provided on a periodic basis in the single corrugated fin 2.

By virtue of the above configuration, from an end portion of the drain slit 23 in an upper fin 21 in the horizontal direction, the condensed water 4 falls down onto a lower fin 21. The condensed water 4 that has fallen onto the lower fin 21 joins condensed water 4 that is retained on a surface of the lower fin 21 and does not easily flow. Because of this confluence, the resultant condensed water 4 easily flows down through the drain slit 23 of the lower fin 21 since the amount of the resultant condensed water 4 is increased. As a result, the amount of the condensed water 4 retained on the surface of the fin 21 decreases, and the condensed water 4 can be efficiently drained.

Figure 5:
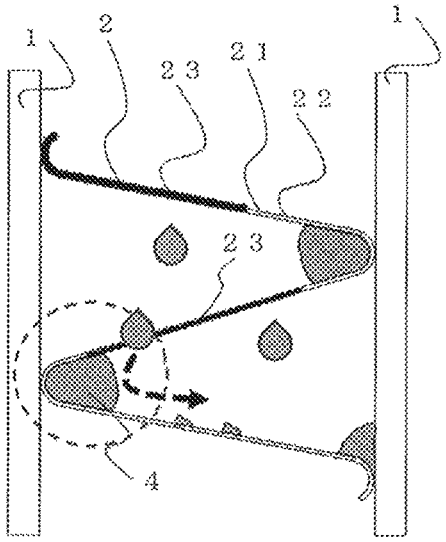
FIG. 5 is an explanatory view for the flow of condensed water on surfaces of fins 21 according to Embodiment 1.

FIG. 5 is an explanatory view for the flow of the condensed water on the surface of each of the fins 21 according to Embodiment 1, The fin 21 is bent with respect to a ridge portion that is a portion at which a flat heat exchange tube 1 and a corrugated fin 2 are joined together. Thus, the distances between the fins 21 are decreased. Thus, the condensed water 4 at the ridge portion is retained and easily remains on the ridge portion because of a surface tension occurring at the condensed water 4.

In the heat exchanger 10 according to Embodiment 1, for example, as illustrated in FIG. 5, the end portion of the drain slit 23 in the horizontal direction can be located at the ridge portion or in the vicinity of the ridge portion. This location corresponds to the position of the drain slit 23 in each of FIG. 4, (d) and FIG. 4, (e). When the end portion of the drain slit 23 in the horizontal direction is located in the vicinity of the ridge portion, the condensed water 4 at the ridge portion and the condensed water 4 that falls from the upper fin 21 can join together. When the condensed water 4 at the ridge portion joins the condensed water 4 that falls from the upper fin 21, the surface tension is broken, the condensed water 4 flows out from the ridge portion, and flows along the lower fin 21. Furthermore, in the case where drain slits 23 are provided at either of both end portions of the fin 21 in the horizontal direction, the drainage performance is further improved. These locations correspond to the positions of the drain slits 23 in each of FIG. 4, (a), FIG. (b), and FIG. (c).

As described above, in the heat exchanger 10 according to Embodiment 1, in each of the corrugated fins 2, the drain slits 23 in at least adjacent ones of the fins 21 that are adjacent to each other in the height direction are offset from each other in the horizontal direction. Therefore, condensed water 4 that has fallen from the drain slit 23 in the upper one of the above adjacent fins 21 can join condensed water 4 that is retained on the surface of the lower one of the adjacent fins 21 and that does not easily flow. Because of this confluence, the resultant condensed water 4 can be drained from the drain slit 23 in the lower fin 21. It is therefore possible to reduce the amount of the condensed water 4 that is retained on the surface of the fin 21, and thus reduce deterioration of the heat exchange performance.

Embodiment 2

Figure 6:
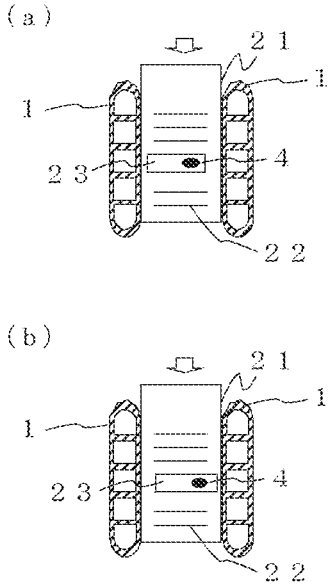
FIG. 6 is an explanatory view for an example of drain slits formed in a corrugated fin in a heat exchanger according to Embodiment 2.

FIG. 6 is an explanatory view for an example of drain slits formed in a corrugated fin in a heat exchanger according to Embodiment 2. FIG. 6 illustrates a state of a plate material that has not yet been subjected to corrugating processing. The length, etc. of the drain slit 23 and other components in the horizontal direction described regarding Embodiment 1 will be defined. For example, as illustrated in FIG. 6, (a) and (b), the intervals at which drain slits 23 are formed may be adjusted such that each of the drain slits 23 is located in an area in which the ridge portion is not located and the drain slit 23 does not extend over the boundary between adjacent fins 21. As described above, the ridge portion is a portion at which a flat heat exchange tube 1 and a corrugated fin 2 are joined together. Because of the above adjustment, all the fins 21 can have respective independent drain slits 23, and it is possible to reduce deterioration of the heat exchange performance and improve the drainage performance, without reducing the contact area between the flat heat exchange tube 1 and the corrugated fin 2.

Figure 7:
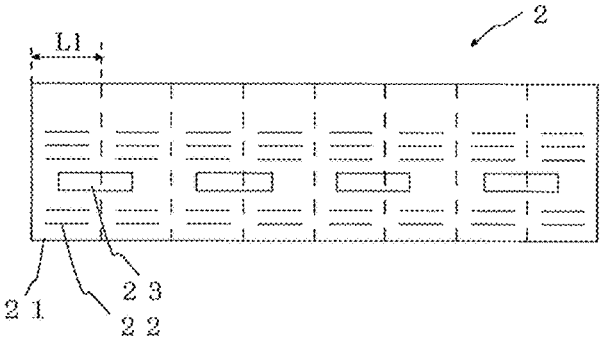
FIG. 7 is an explanatory view for another example (first example) of the drain slits in the corrugated fin in the heat exchanger according to Embodiment 2.

FIG. 7 is an explanatory view for another example of drain slits formed in a corrugated fin in the heat exchanger according to Embodiment 2. FIG. 7 illustrates a state of a plate material for the corrugated fin 2 that has not yet been subjected to the corrugating processing. As illustrated in FIG. 7, the dimension of the drain slit 23 in the horizontal direction may be set longer than the dimension L1 of the fin 21 in the horizontal direction. In that case, the drain slit 23 includes the ridge portion and extends over the boundary between the adjacent fins 21.

Figure 8:
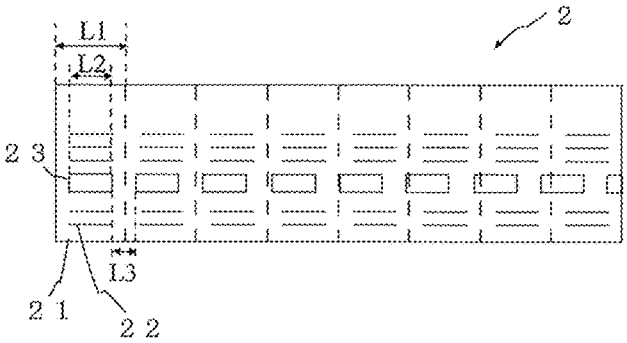
FIG. 8 is an explanatory view for a further example (second example) of the drain slits in the corrugated fin in the heat exchanger according to Embodiment 2.

FIG. 8 is an explanatory view for a further example (second example) of the drain slits formed in the corrugated fin in the heat exchanger according to Embodiment 2. FIG. 8 illustrates a state of a plate material for the corrugated fin 2 that has not yet been subjected to the corrugating processing. In contrast to the drain slits 23 as illustrated in FIG. 7, the dimension L2 of each of the drain slits 23 as illustrated in FIG. 8 in the horizontal direction may be set smaller than the dimension L1 of the fin 21 in the horizontal direction. Furthermore, referring to FIG. 8, the drain slits 23 in the fins 21 are arranged at regular intervals of dimension L3. Thus, in the horizontal direction of the fin 21, an area including the drain slit 23 can include an area where water is drained from the drain slit 23 and an area where heat is transferred through the fin 21, It is therefore possible to reduce deterioration of the heat exchange performance, while improving the drainage performance. Furthermore, when the plate material is subjected to the corrugating processing and the corrugated fin 2 is manufactured, the strength of each of the fins 21 can be kept high.

Figure 9:
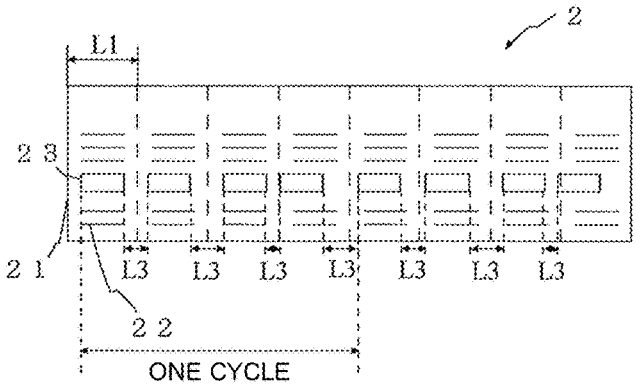
FIG. 9 is an explanatory view for still another example (third example) of the drain slits in the corrugated fin in the heat exchanger according to Embodiment 2.

FIG. 9 is an explanatory view for still another example (third example) of the drain slits formed in the corrugated fin in the heat exchanger according to Embodiment 2. FIG. 9 illustrates a state of a plate material of the corrugated fin 2 that has not yet been subjected to the corrugating processing. In the corrugated fin 2 as illustrated in FIG. 9, the dimension L3 of the interval between the drain slits 23 in adjacent fins 21 varies from one pair of adjacent fins 21 to another. Therefore, the drainage performance and the heat exchange performance can be balanced on the basis of the design.

Figure 10:
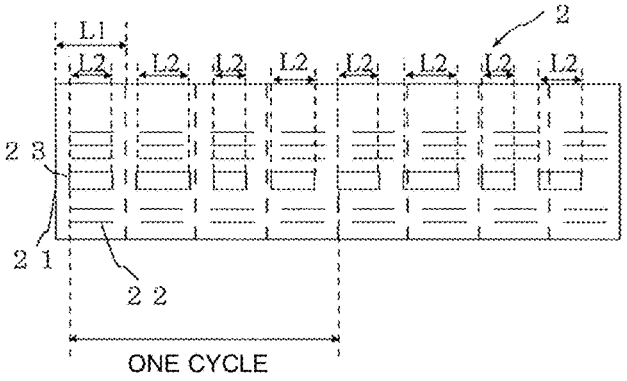
FIG. 10 is an explanatory view for a still further example (fourth example) of the drain slits in the corrugated fin in the heat exchanger according to Embodiment 2.

FIG. 10 is a still further example (fourth example) of the drain slits in the corrugated fin in the heat exchanger according to Embodiment 2. FIG. 10 illustrates a state of a plate material of the corrugated fin 2 that has not yet been subjected to the corrugating processing. In the corrugated fin 2 as illustrated in FIG. 10, the dimension L2 of the drain slit 23 in the horizontal direction varies from one drain slit 23 to another. Therefore, the drainage performance and the heat exchange performance can be balanced on the basis of the design.

The distances between the drain slits 23 in the fins 21 in the corrugated fin 2 may be equal to each other, or as illustrated in FIGS. 9 and 10, may be changed such that the distances are equal to each other on a periodic basis. In the case where the distances between the drain slits 23 are equal to each other or are changed in such a manner as to be equal to each other on a period basis, the drain slits 23 and the louvers 22 can be formed by processing using a corrugating punch roller, a corrugating cutter (roller), or similar tools. Because of the use of the corrugating punch roller or a similar tool, the processing in manufacturing the corrugated fin 2 can be accelerated.

Embodiment 3

Figure 11:
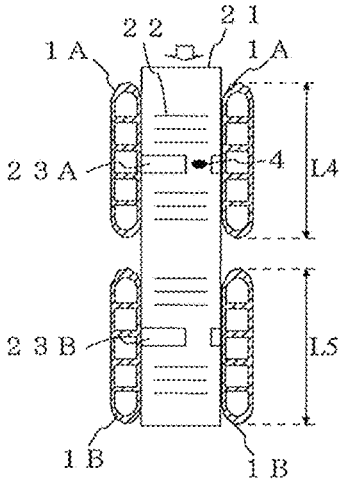
FIG. 11 is an explanatory view for a corrugated fin in a heat exchanger according to Embodiment 3.

FIG. 11 is an explanatory view for a corrugated fin in a heat exchanger according to Embodiment 3. FIG. 11 illustrates a fin 21 located in a given position in the corrugated fin 2. As illustrated in FIG. 11, in Embodiment 3, flat heat exchange tubes 1 arranged in the depth direction along the planar outer surfaces are provided in rows. In an example illustrated in FIG. 11, the flat heat exchange tubes 1 are arranged in two rows. Of these flat heat exchange tubes 1, the flat heat exchange tubes 1 on the windward side are flat heat exchange tubes 1A, and the flat heat exchange tubes 1 on the leeward side are flat heat exchange tubes 1B. The distance between both ends of each of the flat heat exchange tubes 1A in the longitudinal direction thereof is L4, and the distance between both ends of each of the flat heat exchange tubes 1B in the longitudinal direction thereof is L5. The distances L4 and L5 may be equal to each other or may be different from each other.

Figure 12:
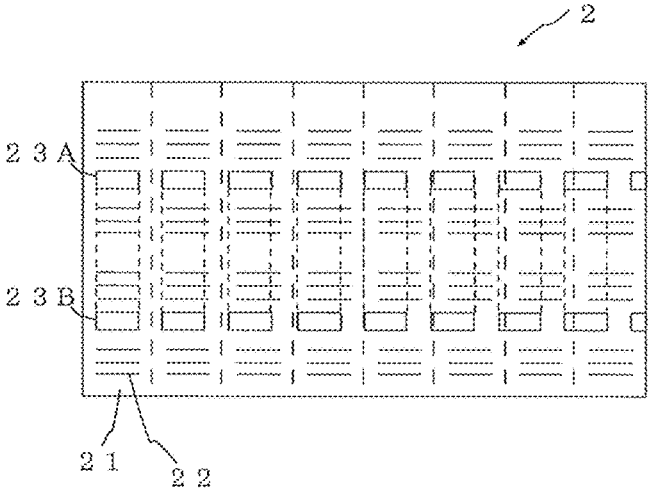
FIG. 12 illustrates a state of the corrugated fin that has not yet been subjected to corrugating processing in Embodiment 3.

Each of the corrugated fins 2 in the heat exchanger 10 according to Embodiment 3 is provided between associated flat heat exchange tubes 1A and between associated flat heat exchange tubes 1B, and is brazed and joined to the flat heat exchange tubes 1A and 1B. In each of the fins 21 in the corrugated fin 2, a first drain slit 23A is provided in an area between the flat heat exchange tubes 1A, and a second drain slit 23B is provided in an area between the flat heat exchange tubes 1B, FIG. 12 illustrates a state of a corrugated fin that has not yet been subjected to the corrugating processing in Embodiment 3. As illustrated in FIG. 12, in each of the fins 21 in the corrugated fin 2 as illustrated in FIG. 11, the first drain slit 23A and the second drain slit 23B are located in the same position in the horizontal direction.

Figure 13:
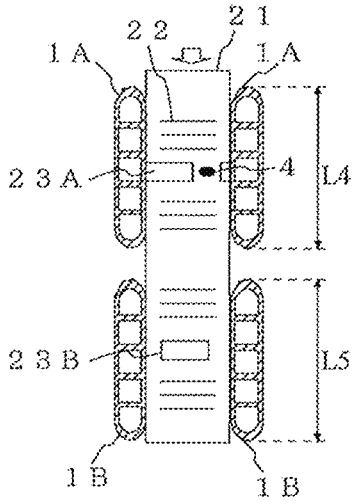
FIG. 13 is an explanatory view for another example (first example) of the corrugated fin in the heat exchanger according to Embodiment 3.
Figure 14:
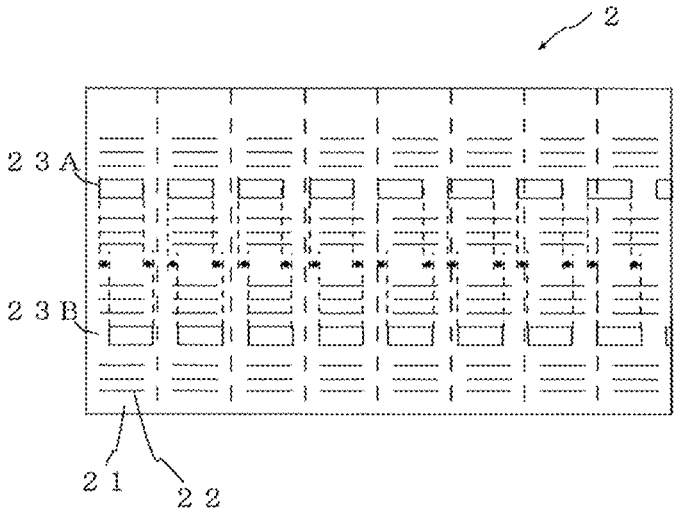
FIG. 14 illustrates a state of the first example of the corrugated fin that has not yet been subjected to the corrugating processing in Embodiment 3.

FIG. 13 is an explanatory view for another example (first example) of the corrugated fin in the heat exchanger according to Embodiment 3. FIG. 14 illustrates a state of the first example of the corrugated fin that has not yet been subjected to the corrugating processing according to Embodiment 3. To be more specific, FIG. 14 illustrates as the state of the corrugated fin 2, a state of a plate material thereof that has not yet been subjected to the corrugating processing. In the fin 21 in the corrugated fin 2 as illustrated in FIGS. 13 and 14, the first drain slit 23A and that of the second drain slit 23B are located at different positions in the horizontal direction.

Figure 15:
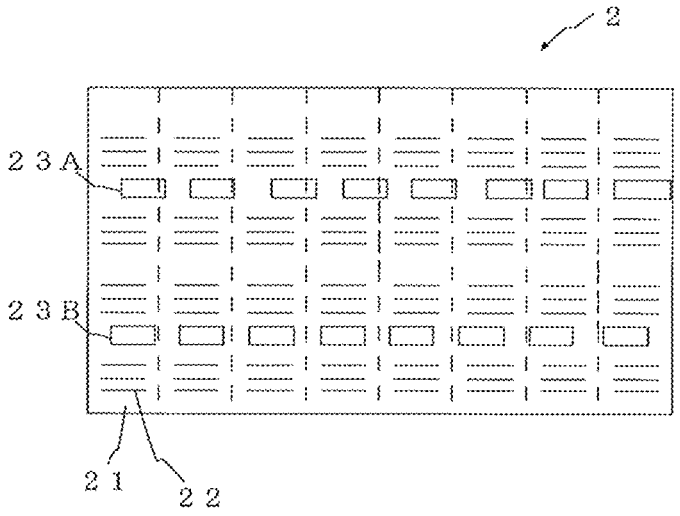
FIG. 15 is an explanatory view for another example (second example) of the positions of drain slits in the heat exchanger according to Embodiment 3.

FIG. 15 is an explanatory view for still another example (second example) of the corrugated fin in the heat exchanger according to Embodiment 3. FIG. 15 illustrates a state of a plate material of the corrugated fin 2 that has not yet been subjected to the corrugating processing. In the fins 21 as illustrated in FIG. 15, first drain slits 23A are located on the windward side, and include a larger number of first drain slits 23A each including a ridge portion and extending over the boundary between associated adjacent fins 21; and second drain slits 23B are located on the leeward side, and include a smaller number of second drain slits 23B each extending over the boundary between associated adjacent fins 21.

In the above manner, by adjusting the distances between the first drain slits 23A and those between the second drain slits 23B in the fins 21, the lengths of these slits, etc., the drainage performance of the fins 21 on the windward side, where the heat exchange performance is higher than that on the leeward side, can be improved, and the heat exchange performance on the leeward side, where the heat exchange performance is lower than that on the windward side, can also be improved. It is therefore possible to reduce deterioration of the drainage performance and the heat exchange performance. Furthermore, since the heat exchange performance on the leeward side is also improved, the difference in heat exchange performance between the fins 21 can be reduced. Thus, the difference in thickness between frost that forms on the surfaces of the fins 21 under a condition where the air temperature is low can be reduced, and the heat exchange performance under the above low-temperature air condition can be improved.

It should be noted that the position of the drain slit 23 in the depth direction is not limited to a specific one. For example, as illustrated in FIGS. 11 and 13, the position of the drain slit 23 in the depth direction is set to a position where the drain slit 23 is surrounded by the louvers 22, that is, where the heat exchange performance is high, whereby water can be drained without reducing the heat exchange performance at the louvers 22.

As described above, according to Embodiment 3, in the heat exchanger 10 in which a plurality of rows of flat heat exchange tubes 1 are arranged in the depth direction along the flow of air, in each of the rows, the drain slit 23 is provided in the area between the flat heat exchange tubes 1. To be more specific, in the above case, the distance between the first drain slits 23A and that between the second drain slits 23B in each row, the silt length, etc., are adjusted. As a result, in a combination of the above slits, that is, the first drain slits 23A and the second drain slits 23B, deterioration of the drainage performance and the heat exchange performance is reduced.

Embodiment 4

Figure 16:
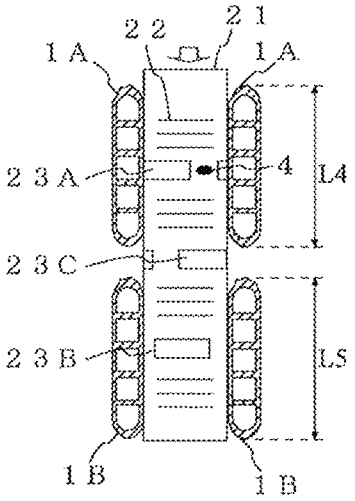
FIG. 16 is an explanatory view for the positions of drain slits in a heat exchanger according to Embodiment 4.

FIG. 16 is an explanatory view for the positions of drain slits in a heat exchanger according to Embodiment 4. In Embodiment 4, in each of the fins 21, a third drain slit 23C is provided in an area between the flat heat exchange tubes 1A and 1B in the depth direction, and is not joined to any of the flat heat exchange tubes 1A and 1B. Since the third drain slit 23C is provided in the area between the flat heat exchange tubes 1A and 1B, it is possible to improve the drainage performance in an area where the heat exchange performance is low.

Embodiment 5

Figure 17:
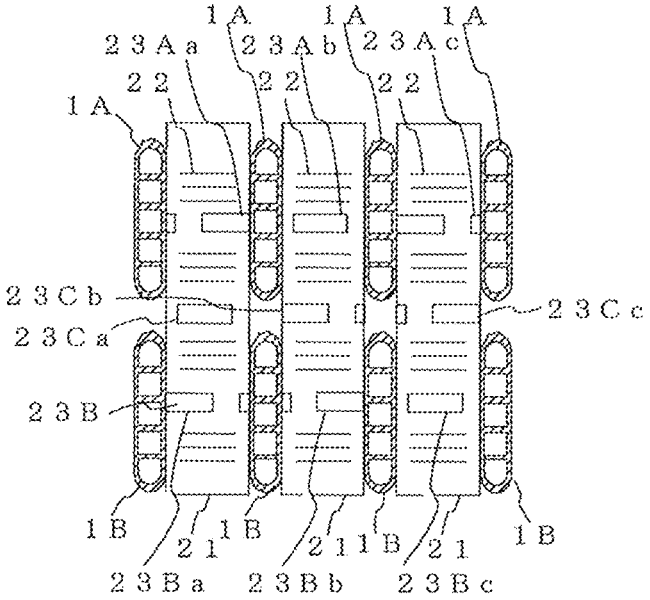
FIG. 17 is an illustration for describing the positions of drain slits in a heat exchanger according to Embodiment 5.

FIG. 17 is an explanatory view for the positions of drain slits in a heat exchanger according to Embodiment 5. In Embodiment 5, in the plurality of corrugated fins 2 in the heat exchanger 10, the center positions of the drain slits 23 in the horizontal direction in the fins 21 that are located at the same position in the height direction are offset from each other.

The center positions of first drain slits 23Aa to 23Ac in corrugated fins 2*a* to 2*c* as illustrated in FIG. 17 in the horizontal direction are offset from each other. Similarly, the center positions of second drain slits 23Ba to 23Bc and third drain slits 23Ca to 23Cc are offset from each other. In the plurality of corrugated fins 2, since the center positions of the drain slits 23 in the horizontal direction are offset from each other, the drainage performance of the entire heat exchanger 10 can be improved.

Embodiment 6

Figure 18:
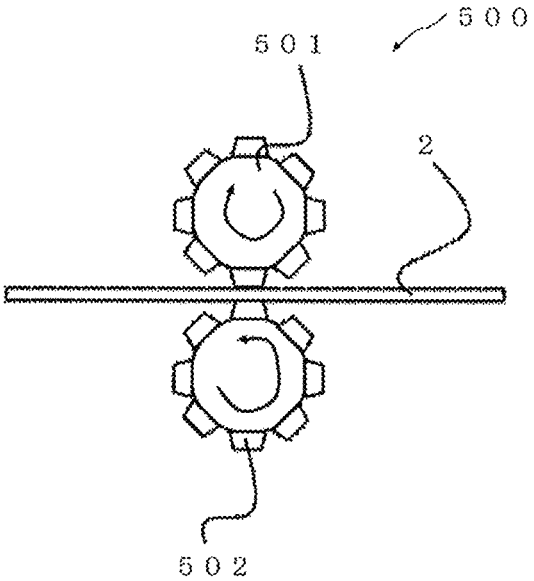
FIG. 18 is an explanatory view for an example of a method of manufacturing a corrugated fin in Embodiment 6.

FIG. 18 is an explanatory view for an example of a method of manufacturing a corrugated fin according to Embodiment 6. FIG. 18 illustrates an example of a punch roller 500 for use in manufacturing the corrugated fins 2 according to Embodiment 1 to Embodiment 5. Using the punch roller 500, the drain slits 23 are formed in a plate material that is to be processed to form the corrugated fin 2. For example, when the plate material is fed between a first roller cutter 501 and a second roller cutter 502 that are arranged in an up-down direction, a through hole that is to form the drain slit 23 can be formed in part of the plate material by the mesh of cutters. In the roller including the above roller cutters, the cutters of each of the roller cutters are provided at different intervals in the rotation direction of the roller cutter, whereby drain slits 23 are formed in the processed plate at different intervals in the horizontal direction. One revolution of each of the first roller cutter 501 and the second roller cutter 502 corresponds to one cycle, and as illustrated in FIGS. 9 and 10, in each of a plurality of cycles, drain slits 23 are formed at different intervals and in the same pattern as in the other cycles. It should be noted that in the case where the length of the circumference of each of the roller cutters is set longer than the length of the corrugated fin 2, drain slits 23 can be formed in the corrugated fin 2 such that the distance between any adjacent drain slits 23 is different from any of the distances between the other adjacent drain slits 23. When the drain slits 23 in the corrugated fin 2 are formed using the punch roller 500, the processing in manufacturing of the corrugate fin 2 can be performed at a higher speed.

REFERENCE SIGNS LIST

1, 1A, 1B: flat heat exchange tube, 2, 2*a*, 2*b*, 2*c*: corrugated fin, 3, 3A, 3B: header, 4: condensed water, 10: heat exchanger, 21: fin, 22: louver, 23: drain slit, 23A, 23Aa, 23Ab, 23Ac: first drain slit, 23B, 23Ba, 23Bb, 23Bc: second drain slit, 23C, 23Ca, 23Cb, 23Cc: third drain slit, 100: indoor unit, 110: indoor heat exchanger, 120: expansion valve, 130: indoor fan, 200: outdoor unit, 210: compressor, 220: four-way valve, 230: outdoor heat exchanger, 240: outdoor fan, 300: gas refrigerant pipe, 400: liquid refrigerant pipe, 500: punch roller, 501: first roller cutter, 502: second roller cutter.

The invention claimed is:

1. A heat exchanger comprising:

a plurality of flat heat exchange tubes each having an elongated cross section and planar outer surfaces that face each other in a horizontal direction, the flat heat exchange tubes each including a fluid flow passage therein; and a plurality of corrugated fins each formed in the shape of waves and provided between associated adjacent ones of the flat heat exchange tubes, each of the corrugated fins having ridge portions that correspond to ridges of the waves and that are joined to the associated flat heat exchange tubes, the corrugated fin having portions that are located between the ridge portions and formed as fins that are arranged in a height direction, wherein the fins include respective drain slits each of which allows water on an associated one of the fins to be drained therethrough, and end portions of the drain slits of any adjacent three of the fins are located at different positions in the horizontal direction, the any adjacent three fins being adjacent to each other in the height direction.

2. The heat exchanger of claim 1, wherein in the corrugated fin, the drain slits are provided in respective areas in which the ridge portions are located, and each extend over a boundary between associated adjacent ones of the fins.

3. The heat exchanger of claim 1, wherein the plurality of flat heat exchange tubes are arranged in rows along the planar outer surfaces, and the corrugated fin is provided between the flat heat exchange tubes of each of the rows.

4. The heat exchanger of claim 3, wherein in the corrugated fin, the drain slit of each of the fins is provided at a position in an area between the flat heat exchange tubes of an associated one of the rows.

5. The heat exchanger of claim 3, wherein in the corrugated fin, each of the fins further includes a drain slit that is located in an area between the rows of the flat heat exchange tubes.

6. The heat exchanger of claim 1, wherein the fins of the corrugated fin include repetitive fins having drain slits located at the same position in the fins in the horizontal direction, the repetitive fins being separated from each other in the height direction on a periodic basis.

7. A refrigeration cycle apparatus comprising the heat exchanger of claim 1.

8. The heat exchanger of claim 2, wherein the plurality of flat heat exchange tubes are arranged in rows along the planar outer surfaces, and the corrugated fin is provided between the flat heat exchange tubes of each of the rows.

9. The heat exchanger of claim 8, wherein in the corrugated fin, the drain slit of each of the fins is provided at a position in an area between the flat heat exchange tubes of an associated one of the rows.

10. A heat exchanger comprising:

a plurality of flat heat exchange tubes each having an elongated cross section and planar outer surfaces that face each other, the flat heat exchange tubes each including a fluid flow passage therein; and a plurality of corrugated fins each formed in the shape of waves and provided between associated adjacent ones of the flat heat exchange tubes, each of the corrugated fins having ridge portions that correspond to ridges of the waves and that are joined to the associated flat heat exchange tubes, the corrugated fin having portions that are located between the ridge portions and formed as fins that are arranged in a height direction, wherein the fins include respective drain slits each of which allows water on an associated one of the fins to be drained therethrough, and end portions of the drain slits of any adjacent two of the fins are located at different positions in a horizontal direction, the any adjacent two fins being adjacent to each other in the height direction, in at least some of the corrugated fins, the drain slits in the fins are not provided in areas in which the ridge portions are provided, and the drain slits in the fins are located in areas in which the ridge portions are not provided, the plurality of flat heat exchange tubes are arranged in rows along the planar outer surfaces, the corrugated fin is provided between the flat heat exchange tubes of each of the rows, and in the corrugated fin, the drain slit of each of the fins is provided at a position in an area between the flat heat exchange tubes of an associated one of the rows.

11. The heat exchanger of claim 10, fins having the drain slit that are located in respective areas in which the ridge portions are not located and fins having the drain slit that are provided in respective areas in which the ridge portions are located and that each extend over a boundary between associated adjacent ones of the fins are mixedly present in the height direction.

* * * * *